US006775607B2

(12) United States Patent
Koerner

(10) Patent No.: US 6,775,607 B2
(45) Date of Patent: Aug. 10, 2004

(54) DIAGNOSTIC SYSTEM AND METHOD TO TEMPORARILY ADJUST FUEL QUANTITY DELIVERED TO A FUEL INJECTED ENGINE

(75) Inventor: Scott A. Koerner, Kenosha, WI (US)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/269,590

(22) Filed: Oct. 11, 2002

(65) Prior Publication Data

US 2003/0120417 A1 Jun. 26, 2003

Related U.S. Application Data

(63) Continuation of application No. 09/681,005, filed on Nov. 13, 2000.

(51) Int. Cl.[7] ..... F02D 41/26

(52) U.S. Cl. ..... 701/104; 701/114; 701/115; 123/480

(58) Field of Search ..... 701/104, 114, 701/115, 33; 123/480, 486, 533

(56) References Cited

U.S. PATENT DOCUMENTS 4,969,435 A * 11/1990 Morikawa et al. ..... 123/533
5,091,858 A 2/1992 Paielli ..... 701/115
5,803,043 A 9/1998 Bayron et al. ..... 123/335
5,862,794 A * 1/1999 Yoshioka ..... 123/486
5,899,189 A 5/1999 Adelsperger et al. ..... 701/104
6,085,142 A 7/2000 Di Leo et al. ..... 701/104
6,549,843 B1 * 4/2003 Koerner ..... 701/104

FOREIGN PATENT DOCUMENTS

WO WO 92/09957 6/1992
WO WO 00/20755 4/2000

* cited by examiner

*Primary Examiner*—Andrew M. Dolinar
(74) *Attorney, Agent, or Firm*—BRP Legal Services

(57) ABSTRACT

The present invention provides a system and method to adjust temporarily the quantity of fuel delivered to the cylinders of a fuel injected engine. The present invention allows a service technician to temporarily adjust the quantity of fuel being delivered to each cylinder or all cylinders of an internal combustion engine. The system includes an internal combustion engine having therein an electronic control unit capable of controlling the fuel quantity delivered to each cylinder and a general service computer connectable thereto and capable of transmitting data to the ECU. When instructed by the service technician, the service computer sends signals to the ECU to adjust fuel injector data to the fuel injectors of so as to increase or decrease the amount of fuel being delivered to the fuel injected engine.

14 Claims, 3 Drawing Sheets

DIAGNOSTIC SYSTEM AND METHOD TO TEMPORARILY ADJUST FUEL QUANTITY DELIVERED TO A FUEL INJECTED ENGINE

CROSS REFERENCE TO RELATED APPLICATION

This application is a continuation application and claims priory of U.S. application Ser. No. 09/681,005, filed Nov. 13, 2000.

BACKGROUND OF THE INVENTION

The present invention relates generally to diagnostic systems for fuel injected engines and, more particularly, to an apparatus and method to adjust the fuel quantity delivered to each cylinder of a fuel injected engine.

Fuel injected engines inject a known quantity of fuel into each cylinder during engine operation based on engine speed, load, engine temperature, air temperature, barometric pressure, and other measurable parameters. This known quantity of fuel is determined for each engine operating point by technicians skilled in the art of internal combustion engines and design, and is a sufficient quantity to cause the engine to run well at each operating point despite numerous manufacturing tolerances that may be encountered. If the engine is not functioning properly, it could be that the wrong quantity of fuel is being delivered to one or more of the cylinders due to a malfunctioning component. It could also be the case that for some other unknown malfunctioning component, the engine requires more or less fuel at a given operating point than a properly functioning engine. While this is not catastrophic, if operated over time with an insufficient amount of fuel being delivered to the engine cylinders, excessive wear and/or breakdown of the engine can occur.

When an engine is not functioning properly, it is most often brought to a knowledgeable and skilled technician for diagnosis and repair. It is often very helpful in the diagnosis of a malfunctioning engine to know if one or more of the engine cylinders is not receiving the desired quantity of fuel. Unlike a carbureted engine, there are no screws in a fuel injected engine for the technician to use to adjust the air/fuel mixture that is delivered to each cylinder. At present, there are no tools which allow technicians to make adjustments to the fuel quantity of a fuel injected engine. Thus, it is very difficult to determine whether the quantity of fuel each cylinder is receiving is the correct amount.

The present invention is for use in an unique diagnostic system for fuel injected engines. Such a system must allow a technician to temporarily adjust the quantity of fuel delivered to each cylinder of the engine. However, it is important to maintain only a temporary change in fuel delivery as a permanent change could violate EPA emission guidelines. It is also important for a technician to be able to precisely adjust the amount of fuel being delivered to the engine cylinder.

It would therefore be advantageous to have a diagnostic system that allows for temporary adjustment of the fuel quantity being delivered to a fuel injected engine.

SUMMARY OF THE INVENTION

The present invention provides a system for adjusting the fuel quantity delivered to each cylinder of a fuel injected engine. The present invention also provides a means for increasing or decreasing the on-time of a fuel injector of the engine. Further, the present invention provides for storing any change in the operating parameters in the internal memory of the engine's electronic control unit (ECU). All of which overcome the aforementioned shortcomings.

In accordance with one aspect of the invention, a diagnostic system is provided for use with a fuel injected engine. A service computer is connected to an engine control unit of the fuel injected engine. The service computer has a computer readable storage medium having thereon a computer program that when executed receives operating data of the fuel injected engine from the engine's ECU. The ECU receives the operating data from a plurality of sensors connected thereto. The plurality of sensors provide operating data of the fuel injected engine including engine speed, load, engine temperature, air temperature, and barometric pressure. The ECU is further connected to a plurality of engine components including a number of fuel injectors. Upon receipt of data from the service computer, the ECU alters the fuel quantity being delivered to the fuel injected engine.

In accordance with another aspect of the invention, a diagnostic machine for use with a fuel injected engine of an outboard motor is provided. The diagnostic machine includes a communications interface connectable to an ECU of a fuel injected engine. The communications interface transmits fuel injector data from the ECU to a processor. The processor is connected to a computer readable storage medium of the diagnostic machine having thereon a computer program that when executed causes the processor to determine an adjustment to fuel injector firing time and further transmit that adjustment to the ECU.

In accordance with yet another aspect of the invention, a method to adjust fuel quantity being delivered to a fuel injected engine is disclosed. The method includes the steps of connecting a diagnostic machine to an ECU of a fuel injected engine. Fuel injector data of the fuel injected engine is then transmitted from the ECU to the diagnostic machine. Next, the method selects at least one engine fuel injector controlled by a control signal having a corresponding pulse width. The method next modifies the injector pulse width based upon at least one user input wherein modification of the injector pulse width results in an adjustment to the fuel quantity being delivered to the fuel injector. The method then transmits the modified injector pulse width of the fuel injector to the ECU of the fuel injected engine where, ultimately, the modified injector pulse width is stored in memory of the ECU.

Another aspect of the present invention provides a system and method for adjusting the fuel quantity being delivered to a fuel injected engine of an outboard marine motor. The method includes the steps of receiving operating parameters of a fuel injected engine, determining the fuel flow of at least one fuel injector based on the operating parameters of the fuel injected engine, modifying the fuel flow of the fuel injector thereby temporarily adjusting the amount of fuel being delivered to the fuel injected engine.

Various other features, objects and advantages of the present invention will be made apparent from the following detailed description and the drawings.

BRIEF DESCRIPTION OF THE DRAWINGS

The drawings illustrate one embodiment presently contemplated for carrying out the invention.

In the drawings.

DETAILED DESCRIPTION OF THE PREFERRED EMBODIMENT

Figure 4:
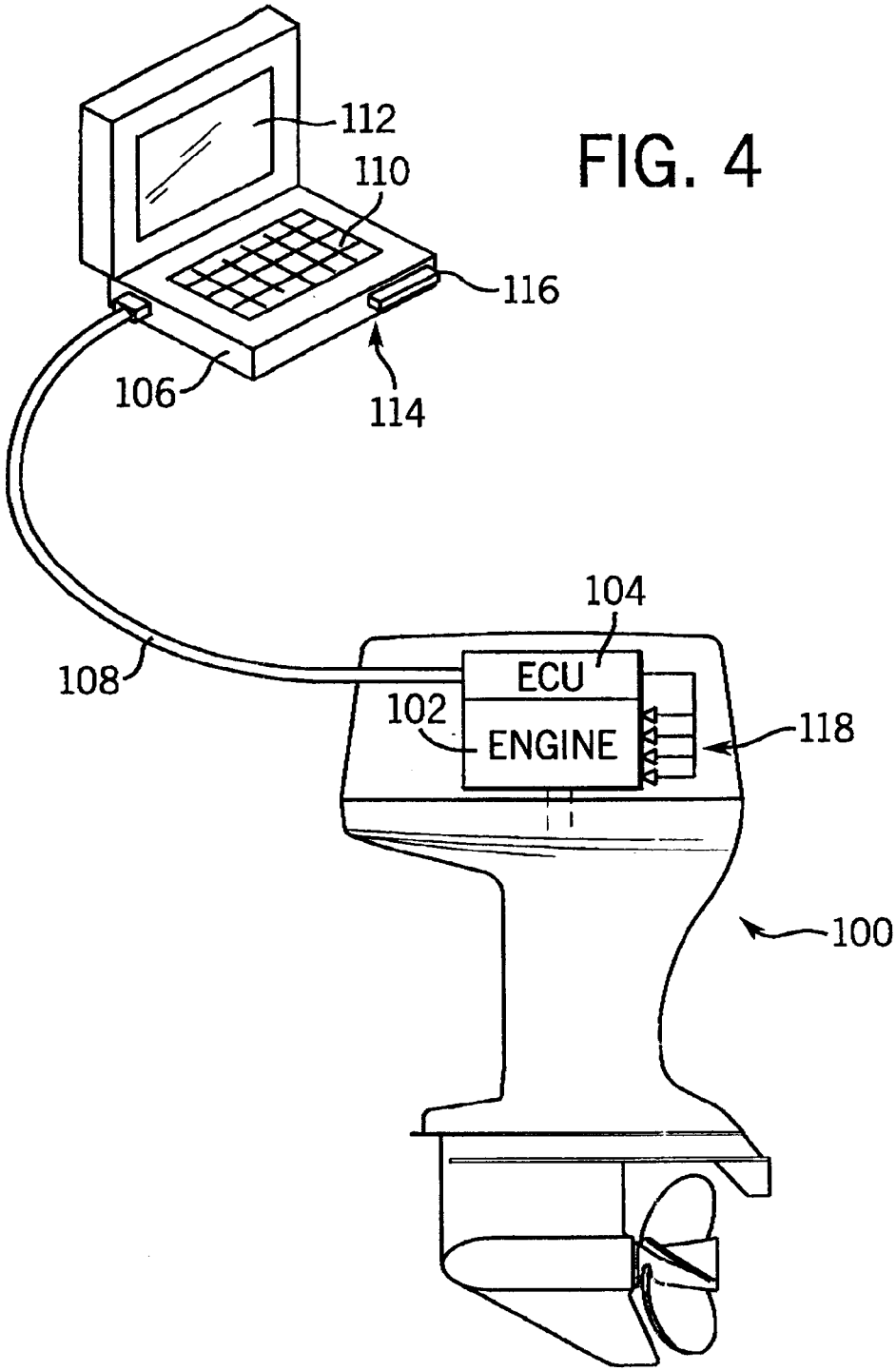
FIG. 4 is a perspective view of a fuel injected outboard marine engine having an ECU in communication with a portable processing unit, incorporating the present invention.

The operating environment of the present invention will be described with respect to a 2-cycle outboard marine engine as best shown in FIG. 4. However, it will be appreciated that this invention is equally applicable for use with a 4-cycle engine, a diesel engine, or any other type of fuel injected engine.

It is well known in the art that the torque of an engine, the engine speed, engine emissions, and engine temperature can be optimized by adjusting the amount of the fuel applied to the cylinders and the time at which that fuel is ignited by using fuel injectors such as that disclosed in U.S. Pat. No. 5,687,050. The amount of fuel injected into an engine cylinder is typically controlled by a width of a control signal pulse applied to the fuel injector to hold it open for a predetermined period of time and then allowing it to close, thus allowing only a particular quantity of fuel to be injected into the cylinder. However, unlike a carbureted engine which has fuel/air mixture screws, there is no mechanism to adjust the amount of fuel delivered to each cylinder of a fuel injected engine. Adjusting the width of the control pulse applied to the fuel injector either results in an increase or decrease in the quantity of fuel delivered to the engine cylinder.

Figure 1:
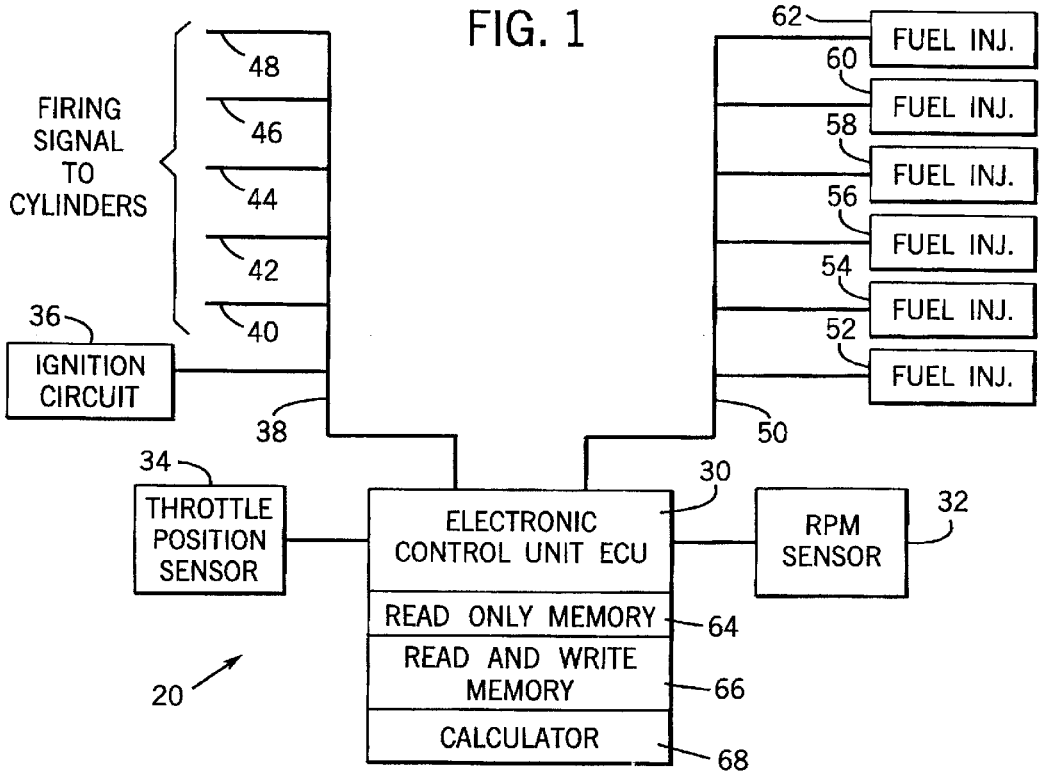
FIG. 1 is a block diagram of a fuel injected engine incorporating the present invention.

Referring now to FIG. 1, a block diagram is shown of an internal combustion engine assembly 20 having a central ECU 30 which receives inputs such as engine speed from RPM sensor 32 and throttle position from sensor 34. It will also be appreciated, that one of the primary purposes of an ECU in an engine application is to control the ignition firing and timing of the ignition circuit 36 by receiving a control signal from ECU 30 on line 38. As shown, the control signal from ECU 30 also controls the firing of each cylinder as indicated by lines 40, 42, 44, 46 and 48. ECU 30 further provides a control signal by means of line 50 to the fuel injectors via fuel injector solenoids as indicated at 52, 54, 56, 58, 60, and 62. Thus, each cylinder of an internal combustion engine receives both an ignition firing signal and a fuel injection signal from the ECU 30.

In addition to those functions provided by an engine ECU in the past, the ECU used in current engines will further include a memory which may typically be a read-only memory 64 for storing a third-order equation such as $ax^3+bx^2+cx+d=0$ and a read/write memory 66 having storage locations associated with each cylinder of the engine for storing the coefficient data specifically associated with each fuel injector to provide fuel to that particular cylinder. The coefficient data is used in the aforementioned third-order equations stored in read-only memory 64. Thus, depending upon the throttle setting and the corresponding RPM, the equation in read-only memory 64 is provided to microprocessor or calculator 68 of ECU 30 along with the appropriate coefficient data of the third-order equation associated with the cylinder for which the volume of fuel is being determined. Microprocessor 68 then uses the equation and the corresponding coefficient data to calculate the necessary pulse width and provide the requisite amount of fuel to the appropriate fuel injection 52–62 to achieve efficient engine operation.

Figure 2:
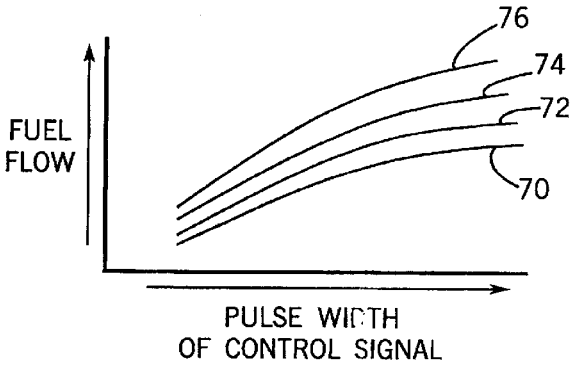
FIG. 2 shows a family of performance curves of fuel injectors which follow a second order polynomial.

To aid in understanding the operation of these complex fuel injectors and the requirement of using advanced calculations to determine pulse width, over those fuel injectors used in the past, reference is made to the set of curves illustrative of fuel injector performance of earlier less complex fuel injectors. As shown in FIG. 2, an increase in pulse width results in an increase in fuel flow in a rather predictable manner as shown by the second-order polynomial curves 70, 72, 74, and 76 representing four individual fuel injectors, as used in a four-cylinder engine. It is clear from each of these curves that if the fuel flow associated with a particular pulse width is known at several different, but known, pulse widths, because of the simple nature and the predictability, the fuel flow at any other pulse width which is not at a known point can be predicted or easily extrapolated with a fair amount of accuracy. Thus, in the prior art fuel injector control calculations it was only necessary to store a few data points which associated fuel flow with pulse width for each fuel injector and then quickly extrapolate for pulse widths for which points were not available.

Figure 3:
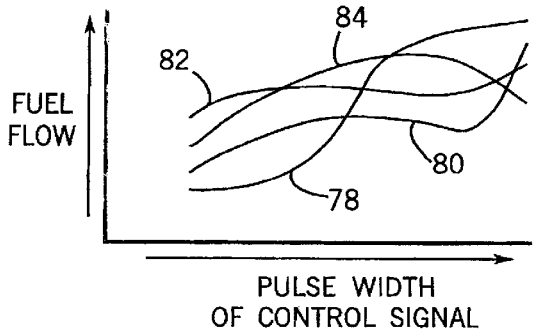
FIG. 3 shows a family of performance curves of complex fuel injectors which follow a third order of polynomial.

However, the advanced complex fuel injectors which can be used with the present invention do not have such predictable pulse width versus fuel flow performance curves. For example, referring to FIG. 3, there is shown a set of four fuel injector performance curves 78, 80, 82, and 84 which clearly cannot be described by a second-order polynomial. Such curves require a third-order polynomial for controlling the performance of these advanced complex fuel injectors. Because of the unpredictability and complexity of these performance curves, it will be appreciated that one cannot simply extrapolate between two desired fuel flow levels and determine the necessary pulse width with any degree of accuracy. The curves shown are exemplary of a third-order polynomial and one skilled in the art will readily understand that the injector fuel flow vs. pulse width curve is coincident with a portion of a third order polynomial curve for a range of pulse widths where the third order polynomial has a positive slope.

Consequently, the basic form of a third-order polynomial is stored in read-only memory 64 of ECU 30 and then for each cylinder the unique and specific coefficients which define a performance curve associated with each specific fuel injector are calculated. Then, as discussed above, by using the third-order polynomial, the necessary pulse width for a desired fuel flow can be determined.

Referring now to FIG. 4, a perspective view of an outboard marine engine 100 having a fuel injected internal combustion engine 102, controlled by an ECU 104 is shown connected to a service computer 106. In a preferred embodiment, the service computer 106 is connected to the ECU 104 with a serial cable 108. However, it is contemplated that the service computer 106 can communicate with the ECU 104 in any number of ways, including but not limited to, a SCSI (Small Computer System Interface) cable and card, a USB (Universal Serial Bus) cable and port, standard parallel connection, or with wireless technology, such as by infrared transmissions. The service computer 106 may be a transportable laptop, a desktop computer, a diagnostic machine, specialized service computer, or any other processing unit capable of executing and running a computer program. The service computer 106 has a keyboard 110, a monitor 112, and at least one disk drive 114. The disk drive 114 can receive an external disk or CD, or any other computer readable storage medium 116. The ECU 104 is individually connected to each of a number of fuel injectors 118 to control the performance of the engine 102, as previously described.

The invention includes a system to replace fuel injector data in the ECU 104. The system includes a service computer 106 connectable to transmit data to the ECU 104. The service computer 106 has a computer readable storage medium 116 associated therewith and having thereon a computer program that when executed receives a series of user inputs through the keyboard 110 or other input interface that upon receipt and analysis ultimately leads to a change in the fuel injector firing time. A computer program is also supplied and will be described further with reference to FIG. 5. In general, the computer program includes a set of instructions which, when executed by a computer, such as the service computer 106, causes the service computer 106 to download an identification characteristic from the ECU 104, and read existing fuel injector coefficient data from the ECU for the fuel injectors. The replacement fuel injector coefficient data from the computer readable storage medium 116 is then written to the ECU 104 for the specific fuel injector selected by the user.

Figure 5:
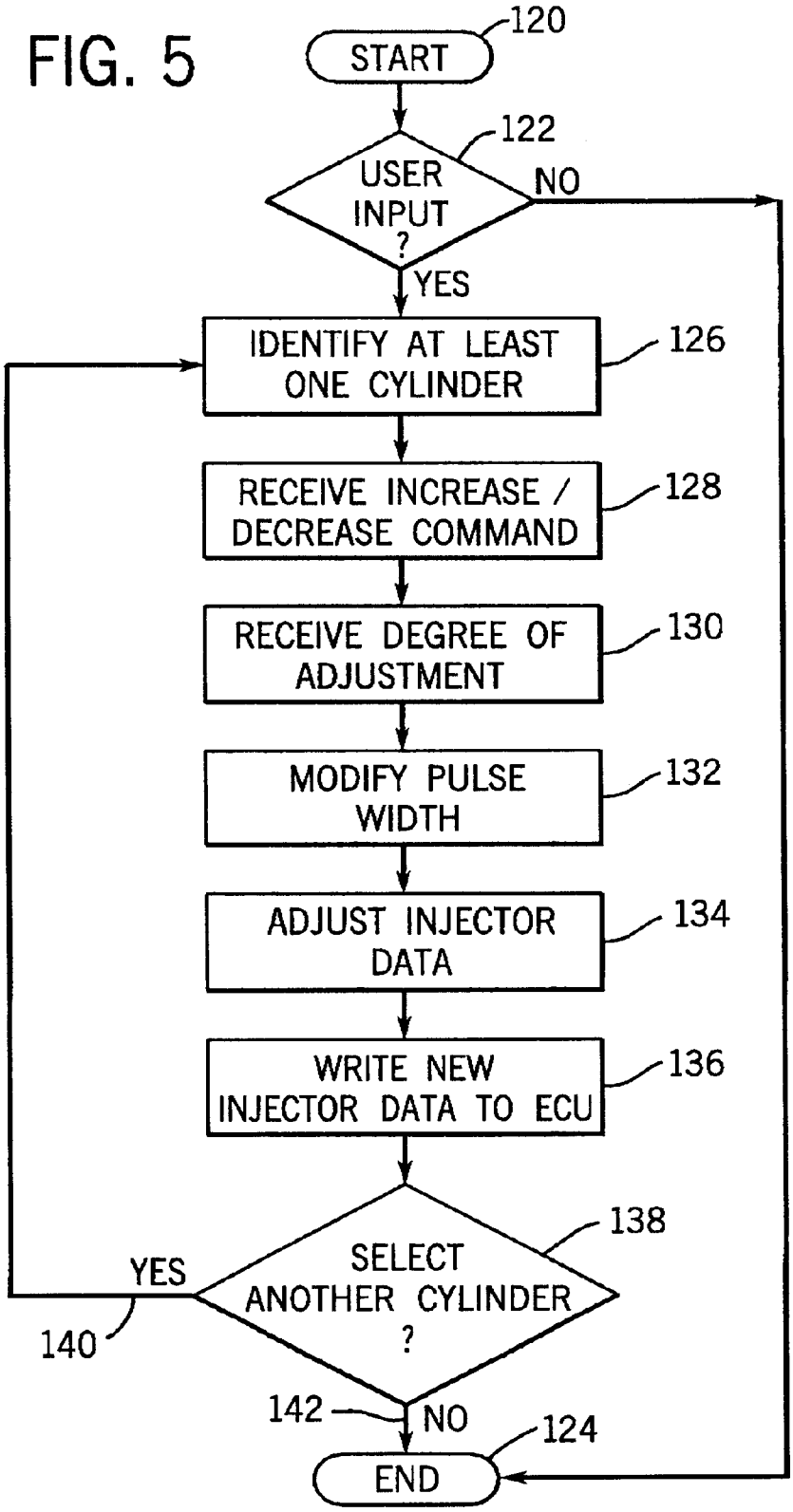
FIG. 5 is a flow chart showing an implementation of the present invention for use with the apparatus of FIGS. 1 and 4.

Referring now to FIG. 5, the method steps of the present invention, together with the acts accomplished by the instructions of the computer program, are depicted in flow chart form. Upon initialization 120, a user, typically a service person, is prompted for an input at 122. If, for some reason, the user does not wish to proceed, the user can exit the program 124 by pressing a key on the keyboard, such as the ESC key on the service computer 106. This branch may also be followed if a time-out feature is added in case the user does not respond to the inquiry at 122. Further, this exit path is also desirable in the event a user wants to just confirm that the service computer 106 is preferably communicating with a given ECU 104 even if adjustment of the pulse width of an injector for that particular engine 102 is not desired.

Once the user selects a cylinder 126 to adjust fuel delivery thereto by adjusting a pulse width of a corresponding fuel injector, the service computer 106 receives an increase/decrease command at 128 from the user. The increase/decrease command indicates to the service computer 106 that the user wishes to increase or decrease fuel delivery to the identified cylinder. The service computer then will lengthen or shorten the pulse width, respectively, of the fuel injector associated with the engine cylinder selected. The service computer 106 then receives the degree of adjustment to be implemented at 130. In a preferred embodiment, the user effectuates a change in the fuel quantity delivered to the fuel injectors by changing the injector pulse width, positively or negatively, in 5 $\mu$s intervals. To facilitate additional ease of effectuating the change in injector pulse width, the present invention allows the user to make adjustments in large increments, typically 50 $\mu$s, or in smaller increments, approximately 5 $\mu$us. For example, to increase the pulse width by 45 $\mu$s, the user would select a large increment increase of 50 $\mu$s followed by a small increment decrease of 5 $\mu$s, rather than selecting a small increase repeatedly or, as in this example, nine times.

Once the service computer 106 receives the degree of adjustment at 130 from the user, the service computer 106 modifies the pulse width of the fuel injector of the engine cylinder accordingly at 132. After the pulse width is modified at 132, the service computer 106 adjusts the injector data at 134 to reflect the modified pulse width. The adjusted injector data is then written to the ECU of the engine at 136.

After the new injector data is written to the ECU at 136, the user is prompted to select another cylinder at 138. If the user desires to select another cylinder at 138, 140 the diagnostic loop returns to 126 wherein the user is prompted to identify which cylinder should next be modified. Alternatively, the user may select to adjust the cylinders an equal amount simultaneously. If the user chooses to not select another cylinder 138, 142 the diagnostic loop 120 is terminated and the user is exited from the program at 124.

The present invention contemplates the use of a fuel injector of a type commonly referred to as single fluid pressure surge direct delivery fuel injector used in gasoline engines, and more specifically, in 2-stroke gasoline engines. One application of such an injector is a 2-stroke gasoline outboard marine engine, as shown in FIG. 4. These fuel injectors typically do not entrain the gasoline in a gaseous mixture before injection. However, it will be appreciated by those skilled in the art that the above-described invention is equally suited for use with other types of injectors. Another type of direct fuel delivery uses a high pressure pump for pressuring a high pressure line to deliver fuel to the fuel injector through a fuel rail that delivers fuel to each injector. A pressure control valve may be coupled at one end of the fuel rail to regulate the level of pressure of the fuel supplied to the injectors to maintain a substantially constant pressure. The pressure may be maintained by dumping excess fuel back to the vapor separator through a suitable return line. The fuel rail may incorporate nipples that allow the fuel injectors to receive fuel from the fuel rail. Thus, in this case, a substantially steady pressure differential, as opposed to a pressure surge, between the fuel rail and the nipples cause the fuel to be injected into the fuel chamber. Another example of direct fuel injection is a direct dual-fluid injection system that includes a compressor or other compressing means configured to provide a source of gas under pressure to affect injection of the fuel to the engine. That is, fuel injectors that deliver a metered individual quantity of fuel entrained in a gaseous mixture. It is to be understood, however, that the present invention is not limited to any particular type of direct fuel injector.

Accordingly, the invention includes a method of servicing an engine requiring adjustment to the fuel injector firing time that includes identifying a fuel injector in need of adjustment by cylinder number and establishing communication between a service computer and an ECU of the engine. The method next includes downloading identification of the ECU, the engine cylinder, and the fuel injector from the ECU to the service computer, and writing adjusted fuel injector data into the ECU for a given fuel injector for the cylinder number identified.

The present invention has been described in terms of the preferred embodiment, and it is recognized that equivalents, alternatives, and modifications, aside from those expressly stated, are possible and within the scope of the appending claims.

What is claimed is:

1. A diagnostic machine to modify fuel flow in a fuel injected engine of an outboard motor, comprising:

a communication interface connectable to an ECU of an outboard motor having a fuel injected engine;

a processor connected to the communication interface capable of receiving fuel injector data from the ECU and transmitting an adjustment value to the ECU; and a computer readable storage medium having thereon a computer program that when executed by the processor and supplied with a user selected degree of adjustment causes the processor to determine the adjustment value, wherein the adjustment value is indicative of a change in fuel injector polynomial coefficients.

2. The diagnostic machine of claim 1 wherein the fuel injector polynomial coefficients are coefficients of a third-order polynomial and the computer program when executed causes the processor to adjust at least one term of the third-order polynomial.

3. The diagnostic machine of claim 2 wherein the computer program when executed further causes the processor to prompt a user for at least one user input.

4. The diagnostic machine of claim 3 wherein the at least one user input includes a user selection of at least one engine cylinder and a desired magnitude and direction of fuel adjustment.

5. The diagnostic machine of claim 4 wherein a positive magnitude of adjustment increases an injector pulse width and a negative magnitude of adjustment decreases the injector pulse width.

6. The diagnostic machine of claim 5 wherein an increase in the injector pulse width increases a fuel quantity flow to the engine cylinder and a decrease in the injector pulse width decreases the fuel quantity flow to the engine cylinder.

7. A method to adjust fuel quantity delivered to a fuel injected engine comprising the steps of:

(A) connecting a diagnostic machine to an ECU of a fuel injected engine;

(B) prompting a user to select at least one injector having an injector pulse width associated therewith;

(C) modifying the injector pulse width based upon at least one user input;

(D) transmitting the modified injector pulse width of the at least one injector to the ECU of the fuel injected engine.

8. The method of claim 7 further comprising the step of applying the modified injector pulse width to the fuel injector data of the fuel injected engine.

9. The method of claim 8 further comprising the step of writing the modified fuel injector data to the ECU.

10. The method of claim 9 further comprising the step of repeating steps (A)–(D) as desired by a user for any remaining engine cylinders.

11. The method of claim 7 wherein the fuel injected engine is an outboard marine engine.

12. The method of claim 7 wherein the at least one injector has a fuel flow defined by a third-order polynomial.

13. The method of claim 12 further comprising the step of adjusting at least one term of the third-order polynomial.

14. A system to adjust fuel injector data of a fuel injected engine incorporated in an outboard motor comprising:

means for communicating with an ECU of a fuel injected engine;

means for identifying and selecting at least one engine cylinder having injector pulse width associated therewith;

means for prompting and receiving at least one user input;

means for modifying the injector pulse width by changing at least one term of a third-order polynomial; and means for communicating the modified injector pulse width to the ECU of the fuel injected engine.

* * * * *